United States Patent [19]

Koppe

[11] Patent Number: 4,694,542

[45] Date of Patent: Sep. 22, 1987

[54] FOLDABLE CLOSURE FOR FLEXIBLE BAGS COMPRISING FLAT SHEET WITH INTEGRAL AXIAL HINGE GROOVE, LEAD IN NOTCH, AND GRIPPING APPERTURE

[76] Inventor: Lou W. Koppe, P.O. Box 567, Athabasca, Alberta T0G 0B0, Canada

[21] Appl. No.: 829,711

[22] Filed: Feb. 14, 1986

[51] Int. Cl.[4] ..... B65D 77/10

[52] U.S. Cl. ..... 24/30.5 S; 24/487; 24/563

[58] Field of Search ..... 24/30.5 S, 563, 555, 24/487; 16/225, 226

[56] References Cited

U.S. PATENT DOCUMENTS

| | | | |
|---|---|---|---|
| 352,325 | 11/1886 | Jensen et al. | 24/563 |
| 833,042 | 10/1906 | Gilbert | 24/563 X |
| 2,396,906 | 3/1946 | Windson | 24/30.5 S X |
| 2,981,990 | 5/1961 | Balderree, Jr. | 24/30.5 S |
| 3,127,656 | 4/1964 | Schwabe et al. | 24/487 |
| 3,164,250 | 1/1965 | Paxton | 24/30.5 |
| 3,222,437 | 12/1965 | Schilling | 16/225 X |
| 3,417,912 | 12/1968 | Paxton | 24/30.5 S |
| 3,713,578 | 1/1973 | Johnson | 16/225 X |
| 3,822,441 | 7/1974 | Paxton | 24/30.5 |
| 3,925,852 | 12/1975 | Wood | 24/30.5 |
| 4,026,413 | 5/1977 | Britt et al. | 24/30.5 S |
| 4,062,144 | 12/1977 | Holden et al. | 16/225 X |
| 4,292,714 | 10/1981 | Walker | 24/30.5 T |
| 4,361,935 | 12/1982 | Paxton | 24/30.5 S |
| 4,416,038 | 11/1983 | Morrone | 24/487 |
| 4,509,231 | 4/1985 | Paxton | 24/30.5 R |
| 4,536,924 | 8/1985 | Willoughby | 24/487 |

FOREIGN PATENT DOCUMENTS

| | | | |
|---|---|---|---|
| 203937 | 7/1957 | Austria | 24/30.5 S |
| 1392907 | 2/1965 | France | 24/563 |
| 16005 | 1/1898 | Switzerland | 24/563 |
| 172916 | 12/1921 | United Kingdom | 24/563 |
| 883771 | 12/1961 | United Kingdom | 24/30.5 S |
| 240214 | 3/1969 | U.S.S.R. | 16/225 |

OTHER PUBLICATIONS

Spencer; "Poly-Pro", Polypropylene; The Integral Hinge, Rec'd, 7/1963.

*Primary Examiner*—Kenneth J. Dorner
*Assistant Examiner*—Laurie K. Cranmer
*Attorney, Agent, or Firm*—David Pressman

[57] ABSTRACT

A flat bag closure (17) of the type having at its edge a V-notch (12) which communicates at its base with a bag neck gripping aperture (14). The closure is made of a non-frangible material so that it can fold along an axis (20) aligned with said notch and said aperture without breaking. The closure thus can be repeatedly bent along such axis to facilitate repeated insertion and removal of a twisted poly bag's neck (36) into and from the aperture. The axis may contain a hinge formed by perforations (19, 24, 26, 28, 30), a concavity (22), or slits (32, 34) to facilitate bending.

9 Claims, 17 Drawing Figures

FOLDABLE CLOSURE FOR FLEXIBLE BAGS COMPRISING FLAT SHEET WITH INTEGRAL AXIAL HINGE GROOVE, LEAD IN NOTCH, AND GRIPPING APERTURE

BACKGROUND

1. Field of Invention

This invention relates to plastic bags of the type commonly used for produce and breads. It is an improved closure for such bags, i.e., it is an improved device for holding the necks of such bags closed.

2. Description Of Prior Art

Produce markets commonly supply transparent polyethylene (poly) bags to shoppers for bagging and carrying home purchased items of produce, such as lettuce and apples. Also such bags are commonly used in factory packaging to provide a resealable outer covering for loaves of bread, as well as for other uses, including non-edibles as well as foods.

When orignally supplied at the factory, these bags were sealed with staples or by heat, but users objected to such methods of closure since they were of a "permanent" nature in that the bags could be opened only by tearing them, thereby rendering them impossible to reseal.

Thereafter several types of closures were provided to seal plastic bags in a way which left the bags undamaged after they were opened. U.S. Pat. No. 4,292,714 to Walker (1981) discloses a complex clamp which can close bag necks without damaging them. However these clamps are prohibitively expensive to manufacture for any mass-merchandising operation. U.S. Pat. No. 2,981,990 to Balderree (1961) shows a closure which is has two holes through which the bag's neck must be threaded and hence is difficult to manipulate, is relatively large, is expensive (it is made of PFTE), protrudes rather than lies flat when installed, and which is not useable unless the bag has a relatively long "neck" or twistable portion. Thus if a bag has a short neck due to a high degree of filling, the latter closure is useless.

Several types of thin, flat closures have been proposed, e.g., in U.K. Patent No. 883,771 to Britt et al. (1961), and in U.S. Pats. Nos. 3,164,250 (1965), 3,417,912 (1968), 3,82,441 (1974), 4,361,935 (1982), and 4,509,231 (1985) to Paxton. While inexpensive to make, useful for bags with a short neck portion, and supplyable in break-off strips, such closures can be used only once. This is because they are invariably made of frangible plastic, yet they must be bent or twisted to remove them. As a result of these two oposing factors, they fracture upon removal. Thus to reseal a bag originally sealed with a frangible closure, it must be resealed either by twisting its neck using a new closure, tying a knot in its neck, folding the neck under the bag so that the weight of the contents will hold the neck closed, or held closed with a twist-type (wire core) closure.

All of these methods of resealing have their disadvantages. The need for a new closure each time the bag is reclosed is very inconvenient. Knotting the neck is inconvenient and difficult to reverse if the knot becomes tight. Folding the neck under is useful only if the neck is long and is unreliable if the bag is moved or picked up since the neck can open and the contents can spill easily. Twist closures are time-consuming to use and become unsightly and inefficient after repeated use.

OBJECTS AND ADVANTAGES

Accordingly, several objects and advantages of the invention are to provide a closure (and variations) which allows a plastic bag to be easily and conveniently opened and resealed without damage, which is simple and inexpensive to use and manufacture, which can be supplied in break-off links, (individual tabs connected side-to-side or end to end), which can be used with bags with short necks, which can be used repeatedly, which obviates the need to tie a know in the bag's neck, fold the neck under the bag, or employ an inconvenient twist-type closure, etc. Further objects and advantages will become apparent from a consideration of the ensuing description and accompanying drawings.

DRAWING FIGURES

In the drawings, closely-related figures are given the same numeric designation but different alphabetic suffixes. The distinctions between figures with different alphabetic suffixes are readily understandable.

DRAWING REFERENCE NUMERALS

Figure 1:
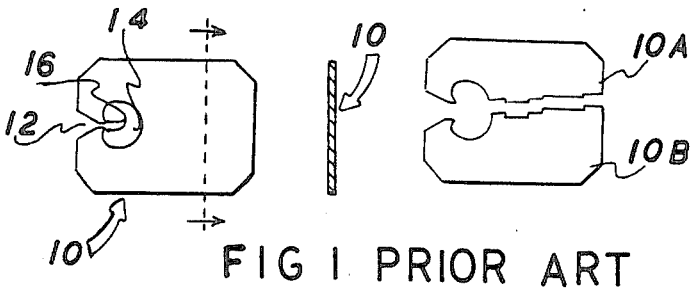
FIG 1 PRIOR ART
FIG. 1 shows a typical prior-art bag closure.

10 prior-art closure
12 V-notch
14 hole
16 points
17 plain non-frangible closure
18 localized bending distortion
19 partial slot or slit
20 bend line
22 concave area
24 spaced slots or slits
26 wide slot
28 single large hole
30 small holes
32 partial slit
33 closure with complete slit
34 complete slit
36 bag neck
38 hand

DESCRIPTION AND OPERATION—FIG. 1—PRIOR ART

The prior-art bag closure of FIG. 1 comprised a thin piece, sheet, or tab of frangible plastic (commonly styrene) 10. It had a V-shaped lead-in notch 12 (FIG. 1A)

which communicated with a wide gripping aperture or hole 14 for holding a bag's neck. The outer corners of closure 10 were typically beveled (cut off) to avoid snagging and personnel injury. When the closure tabs were connected side-to-side in a long roll, these bevels gave the roll a series of V-shaped notches. Such notches acted as detents or indexing means for positioning and conveying the tabs in a dispensing machine. As shown in the middle view in FIG. 1 the closure had a uniform cross section.

In use, closure 10 was placed around a bag's neck by twisting the neck to a narrow, cylindrical configuration (see 36 in FIG. 12A) and inserting such twisted neck into notch 12 until it is forced past the base of the notch and into hole 14. Thus far the prior-art closure operated satisfactorily, albeit users experienced some difficulty in inserting the bag's neck. However to remove closure 10, it had to be bent or twisted upon itself to open aperture 14 so that the bag's neck could be pulled out. (The closure could not be pulled directly off since points 16 at the base of notch 12 dug into the plastic of the bag, preventing it from easily slipping off.) In bending the closure to remove it, the closure invariably fractured along its longitudinal axis, resulting in two pieces, as shown at 10A and 10B in the right view in FIG. 1. This is because prior art closures were made of frangible plastic which could not be bent even once, much less repeatedly. As a result, it could not be reused and had to be discarded after removal.

DESCRIPTION—FIG. 2—PLAIN CLOSURE

Figure 2:
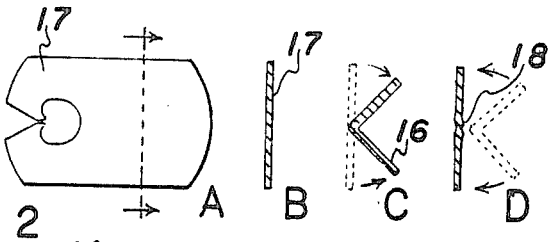
FIG. 2 shows a plain, flexible closure according to the invention.

In accordance with one embodiment of the invention, a closure is made of a non-frangible plastic, as shown in in FIG. 2 at 17. Closure 17 preferably is a slightly elongated or square piece of plastic, similar in size and shape to prior-art closure 10, but is made of a non-frangible material which can be repeatedly bent without fracture.

Preferably closure 17 is made of poly-ehtylene-terephthalate (hereinafter and in the claims "PET"—hyphens supplied for ease of pronunciation), a material which is available from Eastman Chemical Co., Kingsport, TN. PET is most desirable since it can take printer's ink without degradation, it can be pigmented to any desired color, it will distort in any area of bending so as to generate its own hinge area, and it has a lack of memory so that when bent, it will hold the bent shape, just as a strip of lead (Pb) would. However other plastics and materials can be repeatedly bent without fracture and thus are also suitable for use in the closure of the invention. E.g., polyethylene, vinyl, nylon, leather (scraps or findings are most economical), rubber, polypropylene, some unplasticized and plasticized materials, impregnated or laminated fibers, cardboard, paper, etc. could also be used.

As shown in the cross-sectional view of FIG. 2B, which is taken along the line A—A of FIG. 2, closure 17 has a uniform cross section. As shown in FIGS. 2C and 2D, it can be bent along an imaginary horizontal axis extending through the gripping aperture and lead-in notch (an imaginary center horizontal line in FIG. 2A) and then opened to its original state without fracture. As shown best in FIG. 2C, when so bent, it is sufficiently rigid that it will form two substantially flat hinge leaves joined by a relatively sharp, V-shaped bend. Such folding can be performed repeatedly, even if the folding is done so completely so that the two halves are parallel (not shown). Typically the folding leaves some longitudinal distortion, as shown in FIG. 2D at 18. This is desirable since a weakened line, or self-generated hinge, is thus formed at the bend area.

Preferably closure 17 is made of PET with a thickness of 0.8 mm for easy bending, but thickness of up to about 1.2 mm are satisfactory. It has dimensions of from 20×20 mm (square shape) to 30×45 mm oblong shape) with the other dimensions in proportion to those shown. It should be wide enough, to the sides of its horizontal axis, so as to provide enough material so that it can be grasped with the fingers and bent, as indicated. The closure may be dyed yellow or any other readily-visible color. If used at the factory, it may have preprinted price information (not shown). Since its faces are plain, such printing is facilitated.

DESCRIPTION—FIG. 3—PARTIALLY-SLOTTED CLOSURE

Figure 3:
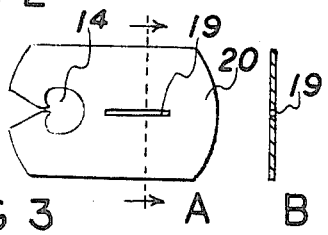
FIG. 3 shows the closure with a partial longitudinal slot or slit.

The closure of FIG. 3 is similar to that of FIG. 2 except that it has a partial longitudinal (elongated) through hole (hereafter "slot") 19 whose length is about 1/3 the length of the closure and centrally placed along a symmetric horizontal axis. Slot 19 is punched or molded and is about 1 mm wide, as indicated in the cross-section view of FIG. 3B. Because slot 19 weakens the closure along its axis 20 which communicates with the aperture and the notch, a "hinge" is effectively provided along such axis. Thus bending of the closure of FIG. 3 is facilitated and will occur in a more precise, more demarcated location. The closure of FIG. 3, as well as those of the subsequent figures, can be made of thicker stock due to the weakening or hinge provided by the slot, slit, foramen etc., shown.

DESCRIPTION—FIG. 4—CLOSURE WITH LONGITUDINAL CONCAVITY

Figure 4:
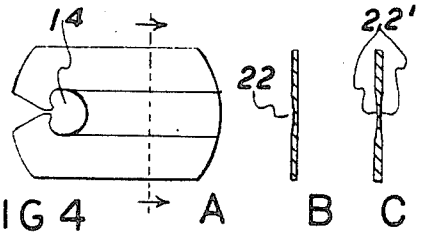
FIG. 4 shows the closure with a broad, longitudinal indentation(s).

The closure of FIG. 4 has a longitudinal concavity 22 which extends from the base of hole 14 to the opposite end of the closure. Its width is about ⅓ the width of the closure. It tapers gradually to a central horizontal thickness of about 0.5 mm. As shown in FIG. 4B, the concavity may be on one side only, or as shown at 22' in FIG. 4C, it may be on both sides of the closure, with the thinnest portion having the same dimension as the one-sided concavity. The concavity can be formed by molding or machining.

The concavity of the closure of FIG. 4 forms a hinge along the axis, and thus has the same advantages of that of FIG. 3, yet does not require a through slot to be punched.

DESCRIPTION—FIG. 5—CLOSURE WITH PLURALITY OF SLOTS

Figure 5:
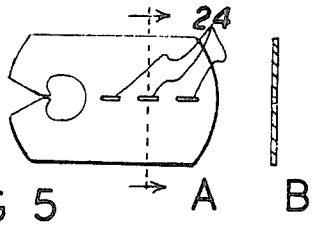
FIG. 5 shows the closure with a plurality of short longitudinal slots or slits.

The closure of FIG. 5 is similar to that of FIG. 3 except that it has a plurality (three in the example shown) of in-line short slots 24 along the closure's axis. Each slot is about ⅓ the length of slot 19 of FIG. 3. This embodiment has a stiffer central portion and is less distortable due to the use of separated slots.

DESCRIPTION—FIG. 6—CLOSURE WITH WIDE PARTIAL SLOT

Figure 6:
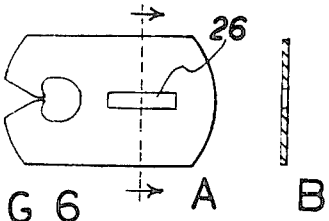
FIG. 6 shows the closure with a short, wide slot.

The embodiment of FIG. 6 utilizes a central partial slot 26. Slot 26 is similar to the slot of FIG. 3, but is wider and shorter than the latter. It can be more easily molded than can the slot of FIG. 3.

DESCRIPTION—FIGS. 7 AND 8—CLOSURE WITH HOLE(S)

Figure 7:
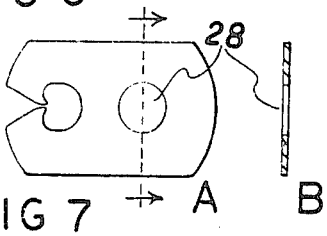
FIG. 7 shows the closure with a circular hole.
Figure 8:
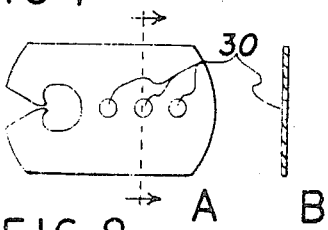
FIG. 8 shows the closure with a plurality of longitudinal holes.

The closures of FIGS. 7 and 8 have either a large central hole 28 or a plurality of smaller in-line holes 30. These holes, which are punched or molded, weaken the central axis of the closure so as to form a "hinge" along such axis. In FIG. 7, hole 28 is about ⅓ the width of the closure and is centrally located. In FIG. 8 the holes are each about ⅛ the width of the closure.

DESCREIPTION—FIGS. 9 AND 10—CLOSURE WITH LONGITUDINAL GROOVE OR SLIT

Figure 9:
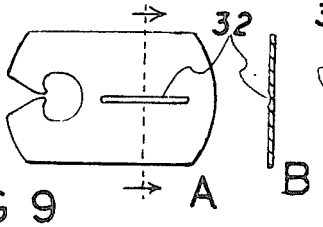
FIG. 9 shows the closure with a partial longitudinal groove or slit.
Figure 10:
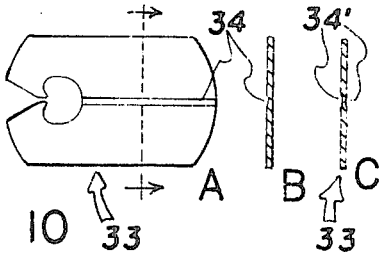
FIG. 10 shows the closure with a full longitudinal groove or slit.

The embodiment of FIGS. 9 and 10 is similar to that of FIG. 3, but instead of a slot, the closure, here designated 33, has a longitudinal removed portion 32 or 34. The removed portion, which may be formed by machining, scoring, rolling, extruding, or, preferably punching at the time the closure per se it punched, thus constitutes a groove, furrow, or slit. It extends part of the length of the closure (slit 32 of FIG. 9) or its entire length, from base of hole 14 to the opposite end of the closure (slit 34 of FIG. 10). The slit, if formed by punching, displaces material, but if formed by machining, actually removes material. It can be formed on one side of the closure (FIGS. 9B and 10B) or on both sides (slits 34' in FIGS. 9C and 10C). The slit in either case preferably is about 1 mm or less wide at the surface and is deep enough so that the closure's thickness at the bottom of the slit (single or double-sided embodiment) is about half of its full thickness. Preferably the slit is narrower, at its widest, than the thickness of the closure. The slit may extend completely through the closure, as does slot 19 of FIG. 3; however it would be far narrower than slot 19.

A slit is very easy to form since it can be formed at the time the closure per se is formed if done by punching. However it still makes a very demarcated hinge which operates most satisfactorily. Moreover slits can be formed without removing material and without marring the closure; thus maximum room is left for printing. For these reasons the slitted closure is the presently-preferred embodiment of the invention.

FIG. 11—BENDING Of FIG. 10 CLOSURE

FIGS. 11 (A to D) show further details of closure 33 of FIG. 10C (double-sided slit) in perspective views. FIG. 11A shows the closure in unstressed (flat) condition. Because of the provision of the slit on both sides, the closure can easily be bent downward along slit 34', as shown in FIG. 11B, or upward as shown in FIG. 11C. As also shown in FIG. 2C, when so bent, it is sufficiently rigid that it will form two substantially flat hinge leaves joined by a relatively sharp, V-shaped bend at groove 34'. In fact, due to the flexible nature of PET, it can even be repeatedly folded so that the two halves are parallel (not shown). The jaws formed by hole 14 at the base of notch 12 can be bent down repeatedly if necessary to remove the closure or to facilitate reinstallation, as shown in FIG. 11D.

FIG. 12—OPERATION OF FIG. 10 CLOSURE

Figure 12A:
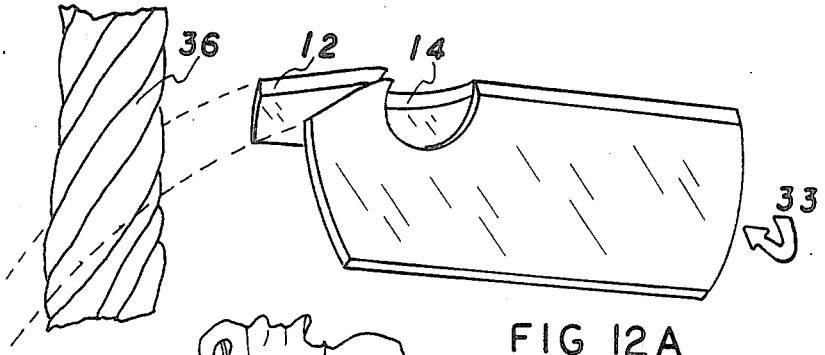
FIGS. 12A–12C show details of the operation of the closure of FIG. 10.

As shown in FIG. 12A, closure 33 is most easily installed. First the bag's neck is twisted to make it narrow and easily manipulated, as shown at 36. Then closure 33 is bent along its slit 34' to form a generally V-shaped member. Closure 33, being formed of PET, will hold this V-shape indefinitely on its own, even if released.

Figure 11A:
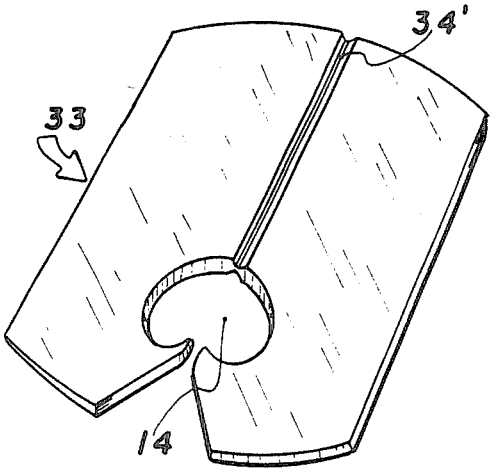
FIGS. 11A–11D show details of the operation and construction of the closure of FIG. 10.
Figure 11B:
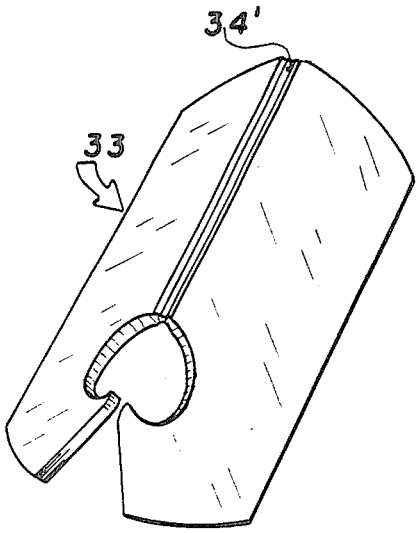
Figure 11C:
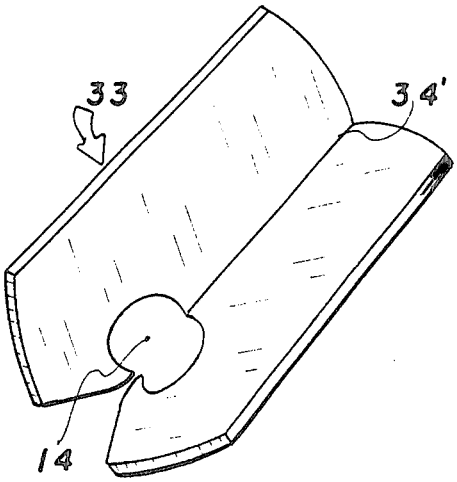

Then (FIG. 12B) the user pushes neck 36 and notch 12 together, as indicated by the arrows. After neck 36 is pushed past notch 12 and into hole 14, closure 33 is bent back to its original flat configuration, as shown in FIG. 11A. Thereupon neck 36 will be securely held by the closure. (If the closure is made of another non-frangible material, such as nylon, it will spring back from the V-shaped configuration by itself.)

In lieu of first bending the closure, it can be inserted directly onto neck 36 in a flat condition. Neck 36 will snap past the base of notch 12 into hole 14, albeit with more effort than if the closure is first bent as shown in FIG. 12A.

Figure 11D:
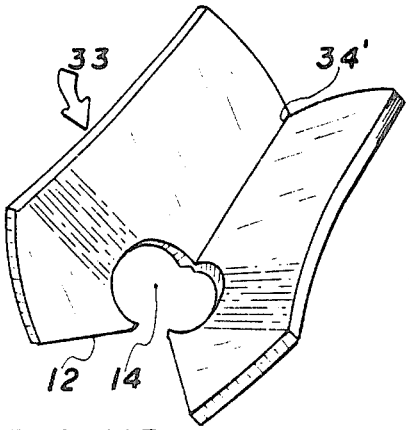

As another alternative, closure 33 can be installed easily onto the bag by first bending its tabs down, as shown in FIG. 11D.

Figure 12B:
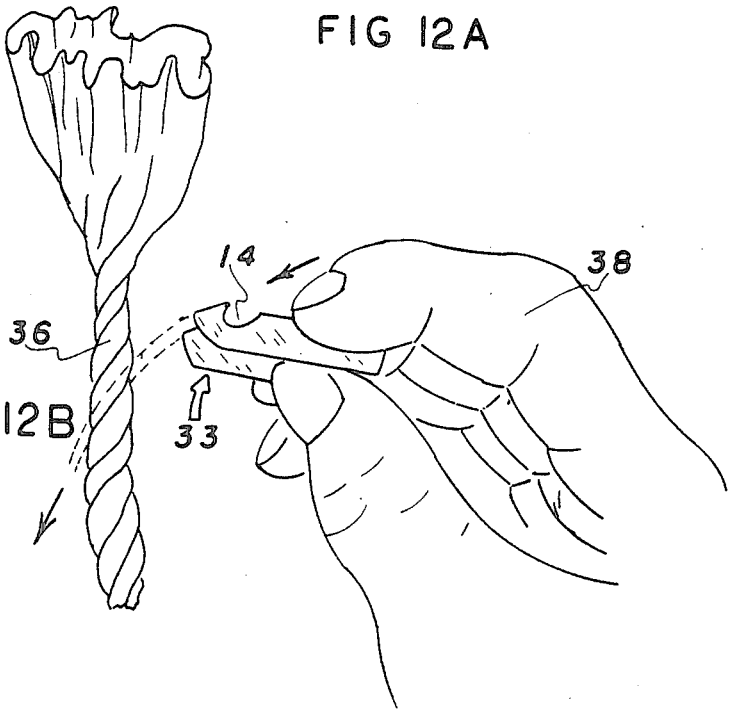

FIG. 12B illustrates how closure 33 is held by a user's hand 38. The thumb is placed under the closure and the first and second fingers are placed on top of the closure, on either side of slit 34'. Thereupon it can be bent easily and installed virtually effortlessly. After installation, it is unbent so that it assumes a flat shape again, whereupon it locks onto neck 36.

Figure 12C:
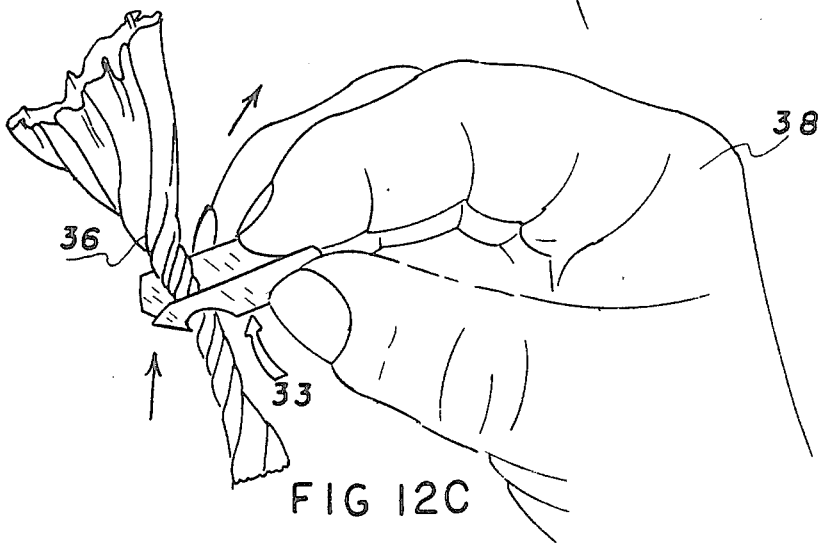

A similar procedure is used to remove the closure. It is held with the first finger on one side and the thumb and second fingers on the other side and bent upwardly to form a V-shaped as shown in FIG. 12C. Then it is removed at an angle to the bag, in the direction shown by the arrows. Its points at the base of its V-notch will trail so that they will not snag on the bag's neck. It will come off neck 36 easily since the constricted area at the base of the V-notch will be greatly widened upon bending of the closure.

SUMMARY, RAMIFICATIONS, AND SCOPE

Accordingly it is seen that, my invention provides several bag closures which can be used to easily and conveniently seal a plastic bag, open the bag just as easily, and then reseal it again with no extra effort. The closure will do this without damaging the bag, it is simple and inexpensive to use and manufacture, it can be supplied in a break-off links (not shown), it can be used with bags with short necks, it can be used repeatedly, it eliminates the need to tie a know in the bag's neck, fold the neck under the bag, or use of an inconvenient twist-type closure. Also it can be used with bags with short necks and it can be removed and installed on a bag's neck far more easily.

While the above description contains many specificities, these should not be construed as limitations on the scope of the invention, but as exemplifications of the presently-preferred embodiments thereof. Many other ramifications and variations are possible within the teachings of the invention. For example, the closure can have other shapes, such as circular, oval, trapezoidal, triangular, etc. It can have a lead-in notch of other shapes. The slots, slits, holes, or grooves can have various other shapes, etc. The hinge can be made of a non-integral portion, such as a strip of adhesive tape connecting two otherwise detached strips.

Thus the scope of the invention should be determined by the appended claims and their legal equivalents, and not by the examples given.

I claim:

1. A bag closure comprising:

a flat sheet of material, said sheet having a lead-in notch extending into said sheet from one edge thereof, said sheet having only a single aperture extending therethrough adjacent to and communicating with said notch via a passageway which is narrower than said aperture, said passageway being shaped so that said notch extends into said aperture with the material of said sheet forming a base of said notch and also forming a pair of points projecting into said aperture, said sheet having an integral hinge along an axis which intersects said notch and said aperture, said hinge comprising a groove along said axis extending partially through said sheet from one side thereof along a straight line from an edge of said aperture opposite said passageway to an edge of said sheet opposite said one edge thereof, said sheet of material being wide enough, in a direction perpendicular to said axis and parallel to said sheet, to be graspable with the fingers os that it can be bent along said axis, and said sheet being made of a non-frangible material and having properties such that:

(a) said sheet can be repeatedly bent along said axis and straightened without fracture, (b) said sheet is sufficiently rigid such that when bent along said axis, said sheet will assume a V-shaped configuration when seen from an end thereof in a direction parallel to said axis, with said axis at the base of said V-shaped configuration and the rest of said sheet forming two flat hinge leaves extending up from said axis, and (c) when bent along said axis, said sheet will assume and remain by itself indefinitely in said V-shaped configuration and when bent back to a flat configuration, it will remain flat indefinitely by itself.

2. The closure of claim 1 wherein said flexible, non-frangible material is polyethyleneterephthalate.

3. The closure of claim 1 wherein said aperture is a circular hole.

4. The closure of claim 1 wherein said hinge comprises a second groove on a side of said sheet of material opposite said one side thereof so that said hinge has two grooves, one on each side of said sheet along said axis.

5. A method of using a bag closure of the type comprising a flat sheet of material hving only a single bag-holding aperture and a lead-in notch at one edge of said sheet which communicates with said aperture via a passegway, comprising:

providing an integral hinge on an axis of said sheet which extends from an edge of said aperture opposite said passageway to an edge of said sheet opposite said one edge thereof, said hinge comprising a groove along said axis which extends partially through said sheet of material, making said closure of a non-frangible material which can be repeatedly bent along said axis of said sheet without breaking said sheet, and which is sufficiently rigid such that when bent along said axis, said sheet will form a V-shaped configuration when seen from an end thereof in a direction parallel to said axis, with said axis at the base of said V-shaped configuration and the rest of said sheet forming two flat hinge leaves extending up from said axis, and when bent along said axis, sais sheet will assume and remain by itself in said V-shaped configuration indefinitely and when bent back to a flay configuration, will remain by itself in said flat configuration indefinitely, making said closure wide enough, in a direction parallel to said sheet and perpendicular to said axis, to enable said sheet to be grasped easily with one's fingers and bent along said axis, and installing and removing said closure onto and from a twisted neck of a plastic bag by first bending said closure along said axis to form said sheet in said V-shaped configuration, then installing or removing said bent closure from said twisted neck, and then unbending said closure to a flattened state so as to securely hold said closure onto said twisted neck.

6. A bag closure comprising a flat sheet of non-frangible material, said sheet having only a single aperture for gripping the neck of a plastic bag when said neck is twisted to a cylindrical configuration, said aperture being opened to an edge of said sheet of material via a passageway which is narrower than said aperture and a notch having a widened mouth at the edge of said sheet, characterized in that said closure includes an integral hinge along an axis of said sheet of material, said axis intersecting said aperture and said widened mouth, said hinge comprising a groove along said axis which extends partially through said sheet of material from one side thereof, said sheet being made of a material which can be repeatedly bent upon itself along said axis without fracture, and which is sufficiently rigid such that when bent along said axis, said sheet will form a V-shaped configuration when seen from an end thereof in a direction parallelto said axis, with said axis at the base of said V-shaped configuration and the rest of said sheet forming two flat hinge leaves extending up from said axis, and which will assume and remain by itself indefinitely in said V-shaped configuration, and such that when bent back to a flat configuration, said sheet will remain by itself in said flat configuration indefinitely, said sheet being wide enough, in a direction perpendicular to said axis and parallel to said sheet, to be graspable with the fingers so that it can be bent about said axis.

7. The bag closure of claim 6 wherein said sheet of material is made of polyethyleneterephthalate.

8. The bag closure of claim 6 wherein said groove is wider, at its widest, than the thickness of said closure.

9. The closure of claim 6 wherein said hinge comprises a second groove on the side of said sheet of material opposite said one side so that said hinge comprises two grooves, one on each side of said sheet along said axis.

* * * * *